US005275144A

United States Patent [19]

Gross

[11] Patent Number: 5,275,144

[45] Date of Patent: Jan. 4, 1994

[54] EVAPORATIVE EMISSION SYSTEM DIAGNOSTIC

[75] Inventor: Rainer P. Gross, Union Lake, Mich.

[73] Assignee: General Motors Corporation, Detroit, Mich.

[21] Appl. No.: 747,238

[22] Filed: Aug. 12, 1991

[51] Int. Cl.[5] ..... F02M 37/04

[52] U.S. Cl. ..... 123/520; 123/198 D; 73/118.1

[58] Field of Search ..... 123/198; 123/518; 123/519; 123/520; 123/521; 73/40.5 R; 73/492; 73/119 A; 73/119 R; 73/118.1; 73/118.2

[56] References Cited

U.S. PATENT DOCUMENTS

| | | | |
|---|---|---|---|
| 4,116,184 | 9/1978 | Tomita | 123/519 |
| 4,520,773 | 6/1985 | Koslow | 73/119 A |
| 4,658,986 | 4/1987 | Freed | 73/40.5 R |
| 4,671,107 | 6/1987 | Chiesa et al. . | |
| 4,741,318 | 5/1988 | Kortge et al. . | |
| 4,794,790 | 1/1989 | Margarit-Metaxa | 73/118.1 |
| 4,838,072 | 6/1989 | Uera | 73/118.1 |
| 4,862,856 | 9/1989 | Yokoe | 123/520 |
| 4,867,126 | 9/1989 | Yonekawa | 123/198 D |
| 4,949,695 | 8/1990 | Uranishi et al. . | |
| 4,962,744 | 10/1990 | Uranishi | 123/520 |
| 4,999,781 | 3/1991 | Holl | 73/119 A |
| 5,027,780 | 7/1991 | Uranishi | 123/520 |
| 5,191,870 | 3/1993 | Cook | 123/520 |

FOREIGN PATENT DOCUMENTS

| | | |
|---|---|---|
| 4012111C1 | 3/1991 | Fed. Rep. of Germany . |
| 62-203039 | 9/1987 | Japan . |
| 63-080033 | 4/1988 | Japan . |
| 2-102360 | 4/1990 | Japan . |
| WO91/12426 | 8/1991 | PCT Int'l Appl. . |

*Primary Examiner*—Carl S. Miller
*Attorney, Agent, or Firm*—Howard N. Conkey

[57] ABSTRACT

The evaporative emission control system of an internal combustion engine is tested by closing the purge air inlet from the atmosphere, applying a vacuum signal to the system, storing the value of a closed loop air/fuel adjustment at the time the vacuum signal is first applied, sensing for the vacuum signal at a specified point in the system and indicating a fault condition if the vacuum signal is not sensed within a first time period and when the amount of the closed loop air/fuel adjustment at the end of a second time period varies from the stored adjustment by an amount less than a predetermined amount.

2 Claims, 4 Drawing Sheets

EVAPORATIVE EMISSION SYSTEM DIAGNOSTIC

BACKGROUND OF THE INVENTION

This invention relates to a system and method for diagnosing an evaporative emission control system of an internal combustion engine.

Vehicle internal combustion engines employ numerous subsystems to effect their operation. The subsystems include, for example, spark timing control, fuel control, and evaporative emission control. The failure of any of the engine subsystems may detrimentally affect the operation of the internal combustion engine in terms of either performance or emissions. Therefore, it is desirable to be able to diagnose the various subsystems of an internal combustion engine so as to evaluate whether or not the subsystem is operating in a satisfactory manner. This invention is directed toward a system and method for diagnosing the operation of the evaporative emission control system of an internal combustion engine.

Engine evaporative emission control systems typically use a fuel vapor recovery canister to control the loss of fuel vapors from vehicle fuel tanks. Generally the canisters take the form of a container filled with activated charcoal or some other absorbing agent which is effective to store the evaporated hydrocarbons until they can be drawn into the induction system of the engine to undergo combustion in the engine cylinders. In these systems, the vacuum in the intake manifold of the engine is used to draw a purge stream of air through the canister so as to purge the collected vapors from the active material of the canister during each engine operation so as to condition the canister for collection of subsequently generated vapors.

These evaporative emission control systems are generally comprised of a combination of hoses, pipes and containments, such as the vapor collection canister and the fuel tank, connected with defined openings to the environment. Defects in such a system will typically show as a leak resulting from, for example, disconnected hoses or a loose or missing gas cap. Defects may further take the form of a restriction such as a pinched line.

SUMMARY OF THE INVENTION

A general object of this invention is to sense the integrity of the evaporative emission control system by detecting leaks in the system or other defects such as an undesirable restriction in the vapor flow lines of the system.

According to one feature of this invention, the evaporative emission control system is tested by closing all normal openings to the environment (such as the purge air inlet from the atmosphere), applying a vacuum signal to the system and detecting that vacuum signal at a specified point in the system. In one specific form, a vacuum switch is positioned in the vehicle fuel tank to sense for the vacuum signal. A failure to sense the vacuum signal (or an excessive delay in sensing the signal) indicates a leak in the emission control system or a restriction in the vapor flow lines. In one aspect of the invention, the vacuum signal is provided by the subatmospheric pressure in the intake manifold of the engine.

In yet another aspect of the invention, a condition in which the fuel/engine operating conditions result in the generation of a high vapor pressure in the fuel tank which prevents detection of the vacuum signal even though the evaporative emission system is fault free is sensed by monitoring the response of the engine fuel system closed loop air/fuel ratio control system to the fuel vapors drawn into the engine intake manifold during the test. In a specific form of this aspect of the invention, the value of the integral term of the closed loop air/fuel ratio adjustment at the time the test is initiated is compared with the value of the integral term after a predetermined period from the time the test was initiated. If there are no leaks or obstructions in the system and the vacuum signal cannot be sensed because of the high vapor pressure in the fuel tank, the resulting vapors drawn into the engine from the tank will cause the integral term to shift by at least a predetermined amount. An integral shift less than the predetermined amount indicates a system fault condition.

DESCRIPTION OF THE DRAWINGS

The invention may be best understood by reference to the following description of a preferred embodiment and the drawings in which:

Referring to FIGS. 1 and 2, there is illustrated an internal combustion engine 10 having a conventional throttle body 12 including a manually operable throttle 14 in a throttle bore 16 for controlling air flow into the engine 10. Air is drawn through the throttle body 12 into an intake manifold of the engine 10 through an air cleaner 18 that further includes a conventional mass air flow sensor for monitoring the mass air flow MAF into the engine 10.

Figure 1:
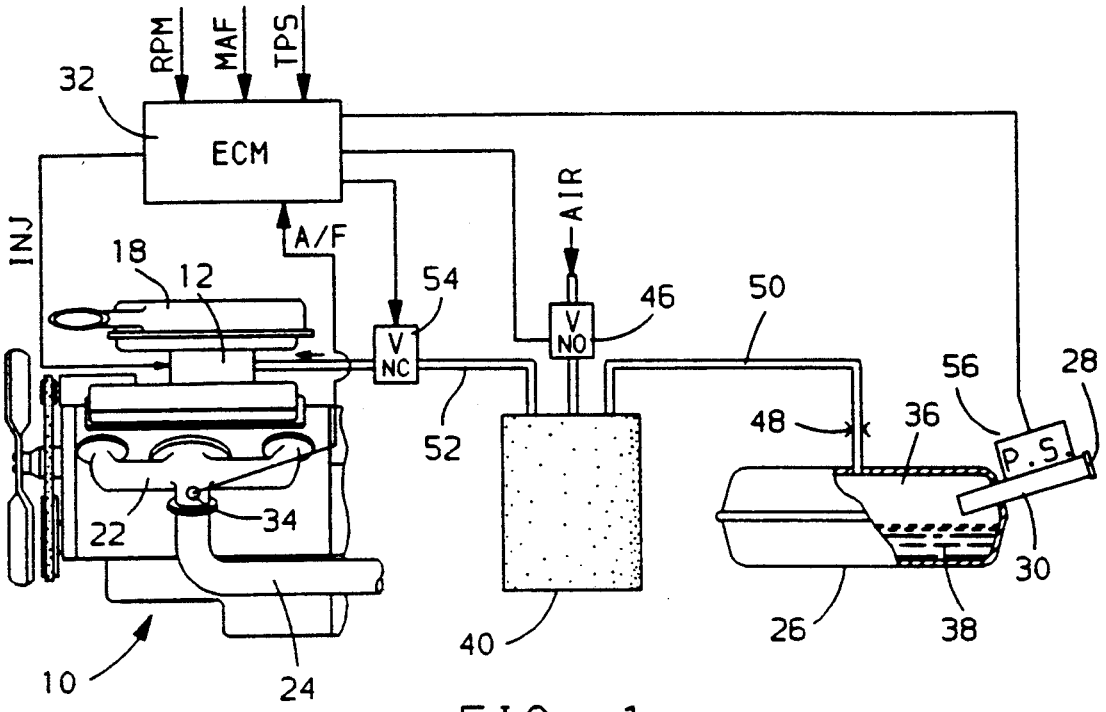
FIG. 1 illustrates an internal combustion engine and associated systems including an evaporative emission control system.
Figure 2:
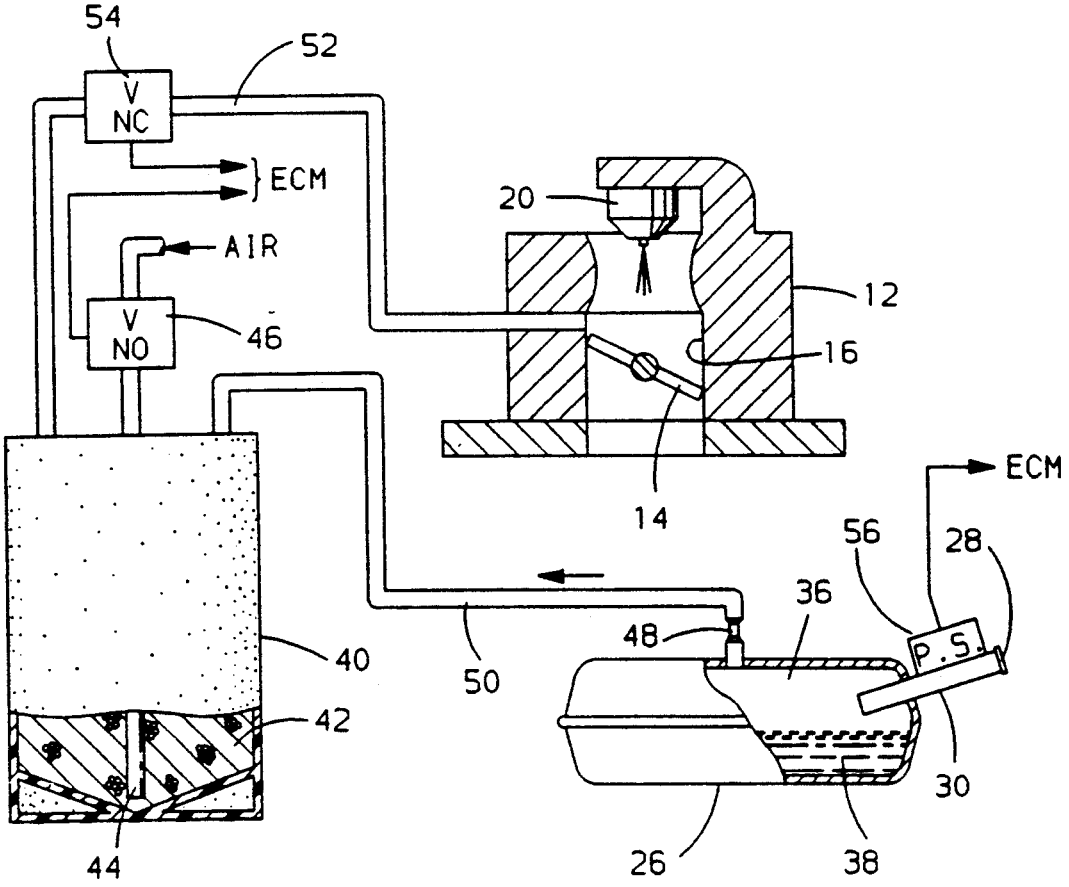
FIG. 2 is a diagram illustrating details of the evaporative emission control system of FIG. 1.

The throttle body 12 also includes a fuel injector 20 positioned above the throttle blade for injecting fuel into the engine 10. The fuel is mixed with the air drawn through the throttle body 12 to provide a combustible mixture that is drawn into the engine intake manifold and then into the cylinders of the engine 10 for combustion. The combustion by-products from the cylinders are discharged into an exhaust manifold 22 and then into an exhaust conduit 24 from which it is discharged into the atmosphere. The fuel delivered to the engine 10 via the fuel injector 20 is drawn from a fuel tank 26 by convention fuel delivery means including a fuel pump, fuel pressure regulator and fuel delivery lines (not shown). The fuel tank 26 is closed off from the atmosphere by a fuel cap 28 on the filler tube 30 of the tank 26.

The fuel injector 20 is controlled by an engine control module (ECM) 32. In general, the fuel injector 20 is controlled by the ECM 32 so as to achieve a desired air/fuel ratio. During an engine warmed up condition, the desired air/fuel ratio is typically the stoichiometric ratio. The fuel injector 20 is energized by an injection pulse INJ provided by the ECM 32 once for each engine cylinder intake event. This injection timing is established by means of a periodic speed reference signal RPM generated by a conventional ignition system in timed relation to engine rotation once for each engine intake event. The duration of the injection pulse is generally determined based on the desired air/fuel ratio and the mass air flow (MAF) into the engine 10 as measured by the mass air flow sensor. The ECM 32 provides for closed loop adjustment of the injection duration during warmed up engine operation so as to achieve the desired stoichiometric air/fuel ratio based upon the output of a conventional oxygen sensor 34 that monitors the oxidizing/reducing condition of the exhaust gases discharged into the exhaust manifold 16 of the engine 10.

The fuel tank 26 includes a volume 36 above the surface of liquid fuel 38 which contains fuel vapors. To avoid excessive fuel tank pressure while at the same time limit fuel vapor escape into the atmosphere, an evaporative emission control system is provided. The principle element of the evaporative emission control system is a conventional vapor storage canister 40 containing a fuel vapor absorbing substance 42 such as activated carbon. The vapor storage canister 40 forms a closed volume that includes a tube 44 having one end exposed to atmospheric air through a normally open electromagnetic valve 46 and whose other end terminates substantially at the bottom of the canister 40. Fuel vapors are transferred from the tank 26 through a vapor restriction 48 and vapor line 50 that terminates at the top of the canister 40 where they are collected in the vapor absorbing substance 42.

A vapor purge line 52 extends from the top of the canister 40 through a normally closed electromagnetic valve 54 to a point in the throttle body 12 just above the throttle 14 when at the closed engine idle position. When the throttle is moved from the closed engine idle position illustrated, the purge line 52 is exposed to the subatmospheric pressure in the engine intake manifold. When the valve 54 is then energized to its open position, this vacuum is applied to the vapor storage canister 40. The position TPS of the throttle is monitored by a conventional throttle position sensor.

The evaporative emission control system functions as follows. When the engine 10 is not operating and during periods in which it is not desired to purge vapors from the canister 40, the valves 46 and 54 are deenergized and fuel vapor pressure in the fuel tank 26 causes fuel vapor to flow through the line 50 into the storage canister 40 where is is absorbed by the vapor storage substance 42. When the engine is operating, and it is desired to purge the collected fuel vapors from the canister 40, the valve 54 is energized by the ECM 32. When the throttle 14 is opened from its closed engine idle position, the subatmospheric pressure in the intake manifold of the engine 10 is applied through the purge line 52 to the top of the canister 40. This vacuum draws air from the atmosphere through the tube 44 to the bottom of the canister 40 and through the vapor storage substance 42 and purges the fuel vapor collected therein. The air and purged fuel vapor are drawn through the purge line 52 into the intake manifold of the engine 10 where it is mixed with the air and fuel otherwise drawn into the engine 10 via the throttle body 12 and then into the engine cylinders where it undergoes combustion. Purging the fuel vapors is terminated whenever the throttle 14 is closed thereby exposing the purge line 52 to atmospheric pressure or by the ECM deenergizing the valve 54.

As is apparent, the performance of the evaporative emission control system described will be detrimentally affected if there is an air leak anywhere in the system or if there is a restriction anywhere in the gas flow path. For example, a rupture of the line 50 or a filler cap 28 that is missing or not sealing would allow fuel vapors to leak to the atmosphere. A restricted line may result in excessive fuel tank pressure with a potential leak of fuel vapors to the atmosphere.

This invention checks the integrity of the evaporative emission control system by sealing the system from the atmosphere, applying a vacuum signal to the system and sensing the vacuum signal level at a predetermined point in the system. The system is sealed from the atmosphere by energizing the valve 46 thereby closing off the air input. A vacuum signal is applied to the system by energizing the valve 54 to couple vacuum from the engine intake manifold to the evaporative emission control system. In the preferred embodiment, the valves 46 and 54 are energized to test the system when the throttle 14 is open as represented by, for example, the output of a conventional throttle position sensor, and engine speed is such that the vacuum in the intake manifold comprising the vacuum signal is of a sufficient magnitude.

A pressure switch 56 for sensing the vacuum signal applied to the evaporative emission control system is positioned in the filler tube 30 and provides a signal to the ECM when the vacuum in the fuel tank 26 exceeds a predetermined value in response to the applied vacuum signal, a condition that will only exist in the absence of an air leak in the evaporative emission control system that exceeds a predetermined air leak limit. Further, an excessive delay in the sensing of the vacuum signal by the pressure switch 56 is indicative of a restriction in the vapor flow path in the evaporative emission control system.

Under certain vehicle operating conditions, fuel volatility and fuel temperature, the vapor pressure in the fuel tank 26 may be such that the vacuum cannot exceed the switch threshold of the pressure switch 56 even in the absence of any air leaks in the system. Under these condition, the preferred embodiment of this invention determines a fault free condition of the evaporative emission control system by monitoring the response of the closed loop air/fuel ratio control function performed by the ECM in response to the output of the oxygen sensor 34. In particular, if the change in the integral term of the closed loop air/fuel adjustment in response to fuel vapors drawn into the intake manifold in response to the application of the vacuum signal exceeds a predetermined adjustment amount over a specified time period, a fault free condition is indicated. The amount of shift in the integral term to indicate a fault free condition is an amount that cannot be achieved over the time period if there are air leaks or restrictions in the evaporative emission control system. Otherwise, the failure of the vacuum switch 56 to sense the vacuum signal and the failure of the closed loop integral adjustment to change by the predetermined amount is indicative of a fault condition in the evaporative emission control system.

The ECM 32 takes the form of a standard digital computer such as a Motorola MC68HC11 microcomputer along with the standard interface and driver circuits for interfacing and conditioning the input and output signals. The operation of the ECM 32 in controlling the fuel injector 20 and for diagnosing the operation of the evaporative emission control system is illustrated in the FIGS. 3, 4*a* and 4*b*. The digital computer contained within the ECM 32 has stored in a read only memory (ROM) the instructions necessary to implement the algorithm as diagrammed in those figures. The specific programming of the ROM for carrying out the functions depicted in the flow diagrams may be accomplished by standard skill in the art using conventional information processing languages.

When power is first applied to the system from a vehicle battery (not shown) the computer program is initiated. The program may first provide for initialization of various random access memory variables to calibrated values and other functions. When this initialization routine is completed, a background loop may be executed that contains various system maintenance routines. This loop may be interrupted by one of possibly several system interrupts whereby control will be shifted to the appropriate interrupt service routine. In this embodiment, one such system interrupt is a high frequency interrupt provided at, for example, 3.125 millisecond intervals whereby a fuel control routine as illustrated in FIG. 3 is executed and another system interrupt is a lower frequency interrupt provided at, for example, 100 millisecond intervals during which the evaporative emission control system diagnostics is executed as illustrated in FIGS. 4*a* and 4*b*.

Figure 3:
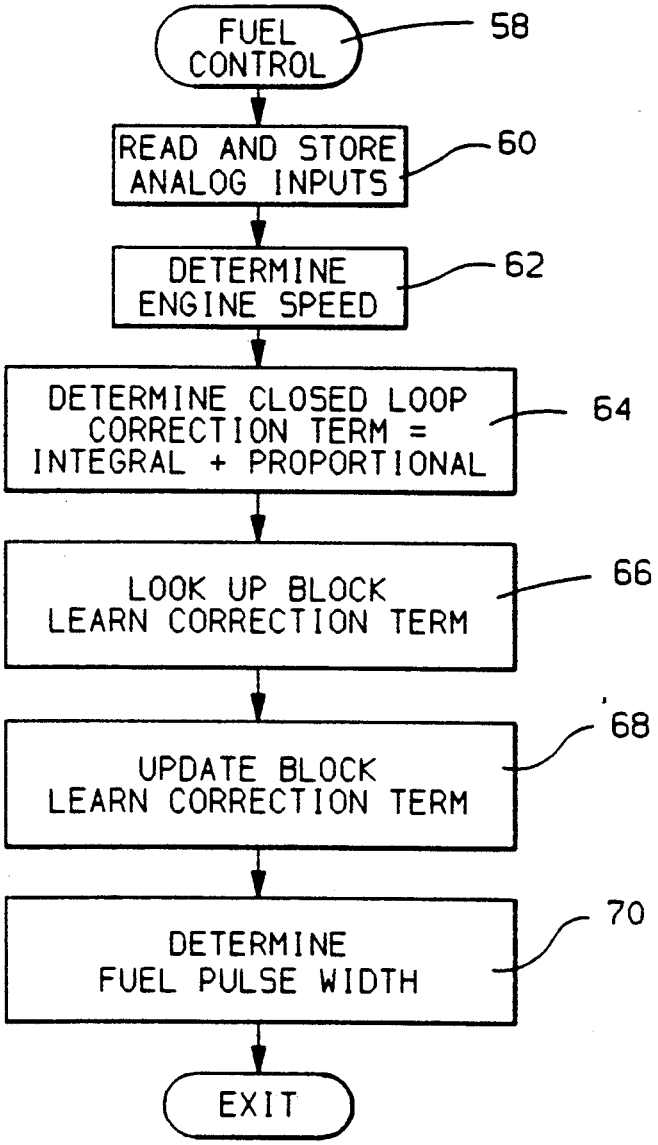
FIGS. 3, 4*a* and 4*b* are diagrams illustrating the operation of the engine control module of FIG. 1 in diagnosing the evaporative emission control system.
Figure 4A:
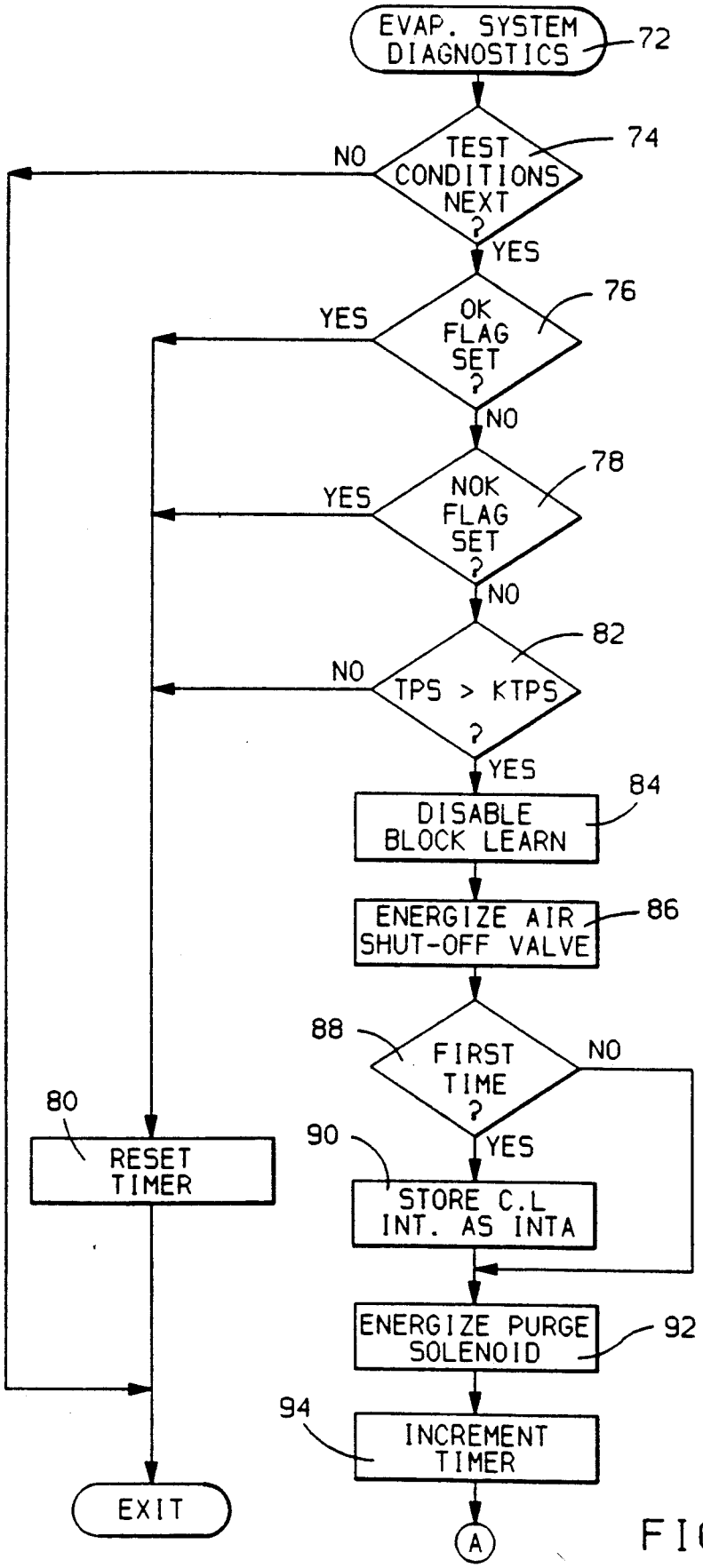
Figure 4B:
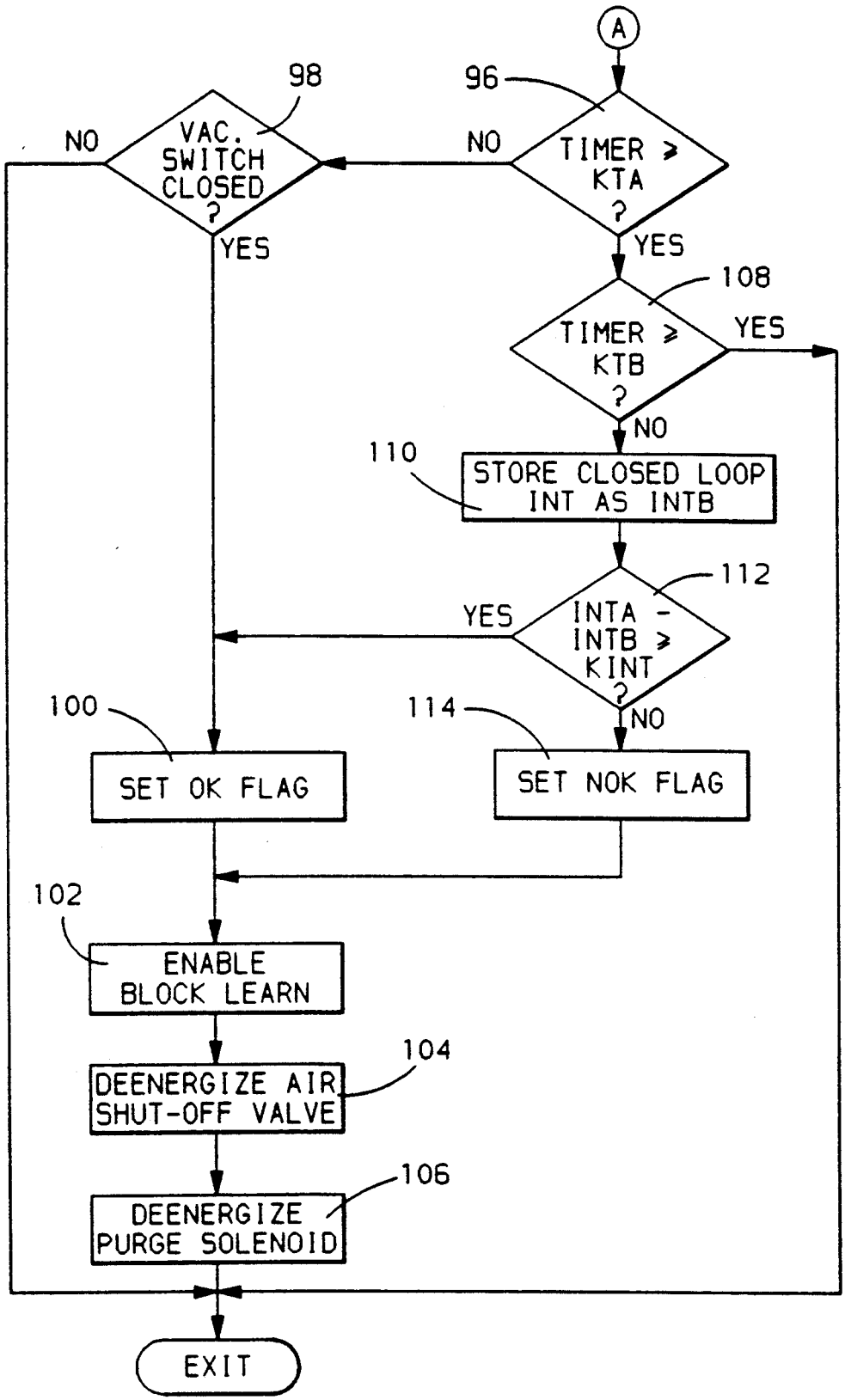

Referring first to FIG. 3, the fuel control routine is generally illustrated that is repeatedly executed in response to the high frequency interrupt This routine generally provides for determining the fuel injection pulse width to be applied to the fuel injector 20. The routine is entered at point 58 and then at step 60 reads and saves the values of the various analog input signals including the mass air flow signal MAF representing the mass air flow into the engine 10 and the value of the air/fuel ratio signal representing the rich or lean condition of the air/fuel ratio of the mixture supplied to the engine relative to the stoichiometric ratio. Thereafter, the routine determines the engine speed at step 62 based upon the frequency of the RPM speed signals. In one embodiment, the time between the RPM speed signals is determined to provide a measure of engine speed.

At step 64, the routine determines a closed loop correction term in the form of a multiplier that trims a computed fuel pulse width. The closed loop correction term provides means for the fuel controller to maintain a constant stoichiometric air/fuel ratio. In general, if the air/fuel signal indicates a lean mixture, the closed loop correction term is adjusted in direction to cause a richer mixture to be delivered to the engine cylinders. Likewise, if the air/fuel ratio signal is indicating a rich mixture, the closed loop correction term is adjusted in direction to cause a leaner mixture to be delivered to the engine cylinders. The resulting correction term is the multiplier that is some value greater than 1 to increase the fuel injection pulse width otherwise determined and some value less than 1 to decrease the fuel injection pulse width otherwise determined.

The closed loop correction term is comprised of the sum of an integral term and a proportional term. The integral term is updated at step 64 based on the state of the air/fuel signal. If the oxygen sensor signal indicates a rich mixture, the integral term is decreased by a predetermined calibrated amount. Conversely, if the air/fuel signal indicates a lean mixture, the integral term is increased by a predetermined calibrated amount. The proportional term of the closed loop correction term is comprised of a predetermined calibration value subtracted from the integral term when the air/fuel ratio signal indicates a rich air/fuel mixture and that is added to the integral term if the air/fuel ratio signal indicates a lean air/fuel ratio. As indicated, the sum of these terms provides for the closed loop correction of the otherwise determined fuel injection pulse width in response to the rich/lean state of the mixture as sensed by the oxygen sensor 34 so as to establish a stoichiometric air/fuel ratio.

The fuel control algorithm may also include a block learn term in the form of a multiplier for providing a trim on the fuel pulse width calculation so as to compensate for factors such as system-to-system variations or changes in the engine operating characteristics over time. The block learn term is comprised of a predetermined number of variables stored in a look-up table in memory at memory locations referred to as block learn memory cells. The individual memory cells are selected or addressed on the basis of the mass air flow rate represented by the mass air flow measured at step 22 and engine speed as computed at step 24. A particular cell is selected via step 66 by execution of a lookup routine when the engine operating point on the air flow/engine speed plane lies within the region corresponding to that cell. The value retrieved from the memory cell addressed by the measured values of mass air flow and engine speed comprise the block learn term multiplier.

At the next step 68, the learn value at the memory cell corresponding to the present engine operating region is updated based upon the closed loop integral term previously described. In one embodiment where the fuel control routine is executed at 3.125 millisecond intervals, this step is executed once for each thirty two executions of the fuel control routine and therefore once each 100 milliseconds. The block learn memory cell corresponding to the present engine operating region is updated based on the state of the closed loop integral correction term. The value stored in the block learn cell corresponding to the current engine operating point is adjusted by a predetermined calibration amount in the direction increasing the fuel amount if the closed loop integral correction term is greater than a predetermined value and conversely the value stored in the block learn cell corresponding to the current engine operating region is shifted in direction to lean the air/fuel mixture if the closed loop integral correction term is less than a predetermined value. The effect of the adjustment of the block learn value at the block learn cell corresponding to the engine operating region is to decrease the correction required by the integral term of the closed loop controller when the engine is operating in that region in order to maintain the desired stoichiometric air/fuel ratio. By continued adjustment of this value over time, the integral term correction required to establish the stoichiometric ratio at this engine operating point is transferred to the calibration block learn term.

The fuel pulse width to be applied to the fuel injector 20 for controlling the fuel quantity delivered to the engine 10 is then determined at step 70. In general, this determination provides for an open loop computation of the fuel pulse width based on the mass air flow measured at step 60 and the desired air/fuel ratio multiplied by the closed loop correction term determined at step 64 and the block learn correction term retrieved from memory at step 66. It is assumed for purposes of describing this invention that the fuel control routine is functioning during a warmed-up engine condition whereby the desired air/fuel ratio is a stoichiometric ratio such that the correction terms applied provide for closed loop control of the air/fuel ratio to that ratio. Thereafter, the routine exits the fuel control routine and returns to the background loop.

Referring to FIGS. 4*a* and 4*b*, there is described the routine executed in response to the lower frequency system interrupt to diagnose the evaporative emission control system. This routine is entered at step 72 and then proceeds to step 74 to determine if the conditions for performing the test are met. These conditions may include, for example, the fuel control routine of FIG. 3 operating in a closed loop air/fuel ratio control mode. If the conditions for performing the diagnostic test are not met the program exits the routine.

As will be described, when the test of the evaporative emission control system has been completed either an OK flag indicating a fault free condition or a NOK flag indicating a sensed fault condition will be set. Both of these flags are initialized to a reset condition during the initialization procedure previously described when power is first applied to the ECM. A set condition of either one of these flags is sensed by steps 76 and 78. If the test has already been performed a timer utilized in the test procedure is reset at step 80 after which the routine is exited. However if neither step 76 or 78 senses a set condition of its respective flag OK or NOK indicating a test of the evaporative emission control system has not been completed, the routine determines at step 82 if the throttle is opened to enable the vacuum signal to be applied to the evaporative emission control system via the purge line 52. This condition is indicated if the throttle position signal TPS is greater than a calibration constant KTPS.

If the throttle position is less than the threshold, the timer is reset at step 78 and the program is exited. However, if step 82 indicates that the throttle position signal TPS is greater than KTPS the routine proceeds to test the operation of the evaporative emission control system. Additional conditions may be required to test the operation of the system. For example, to assure adequate vacuum exists in the intake manifold to perform the test, it may be additionally required that the engine speed be a predetermined magnitude.

First the block learn function of step 68 of FIG. 3 is disabled at step 84 to prevent "learning" based on test conditions versus normal operating conditions. Then at step 86 the valve 46 is energized to close off the atmospheric air input line (the only valid atmospheric air inlet to the system when the throttle valve 14 is opened). If the test of the system is being initiated during the present execution of the diagnostic routine, the value of the integral term of the closed loop adjustment last determined at step 64 is saved in memory as the value INTA. This is accomplished by step 88 which determines if it is being executed for the first time since the system was initialized. If so, the step 90 saves the integral term adjustment in memory as value INTA. During subsequent executions of the routine, step 90 is bypassed.

The purge solenoid 54 is then energized to apply the vacuum signal from the intake manifold of the engine 10 to the closed evaporative emission control system via the purge line 52. The elapsed time from the application of the vacuum signal is monitored by incrementing the timer at step 94 with each execution of the diagnostic routine. This timer is reset during the initialization procedure and thereafter via step 80 as previously described.

If there are no system air leaks and no restrictions in the system, the vacuum signal applied to the purge line 52 will be sensed within a time period KTA. Otherwise, either (A) a fault condition exists or (B) the engine operating/fuel conditions are such that a high vapor pressure exists in the fuel tank 26 which prevents the switching threshold level of the vacuum switch 56 from being attained. Accordingly, for the period KTA as sensed by step 96, the program monitors the output of the vacuum switch at step 98. If closure of the switch is not sensed, the routine is exited from step 98. However, if step 98 senses closure of the switch 56, step 100 then sets the OK flag to indicate a fault free condition of the evaporative emission control system. Thereafter, the system is returned to its normal condition via the steps 102, 104, and 106 by enabling the block learn function of step 66 (step 102), deenergizing the air shutoff valve 46 to open the air input to the storage canister 40 (step 104), and deenergizing the purge solenoid 54 (step 106) which is thereafter controlled by the ECM to control vapor purge from the vapor storage canister 40 in the normal manner via a standard vapor purge control routine. In response to the next execution of the routine of FIGS. 4*a* and 4*b*, the routine will be exited from step 76 via the step 80.

Returning to step 96, if the time since the application of the vacuum signal becomes equal to KTA and step 98 had not yet sensed closure of the vacuum switch 56 in response to the vacuum signal, either a fault condition exists or a legitimate condition exists that prevents the vacuum signal from being sensed by the switch 56 even though the system is fault free. As indicated this condition may result from a combination of factors including high fuel temperature and high volatile fuel that give rise to a high vapor pressure level in the fuel tank 26. If this condition exists, the result will be a large volume of fuel vapors being drawn into the intake manifold of the engine from the fuel tank 36 via the lines 50 and 52 and the canister 40. The fuel control routine of FIG. 3 responds to the resulting rich condition of the mixture as sensed by the oxygen sensor 34 by adjusting the integral term of the closed loop correction term via step 64 in direction reducing the fuel pulse width so as to maintain the stoichiometric air/fuel ratio. By monitoring the amount of adjustment of the integral term, the diagnostic routine thereby determines if the evaporative emission control system is fault free even though the vacuum signal was not sensed by the pressure switch 56.

First, when step 96 senses expiration of the period KTA, the time since the application of the vacuum signal and as represented by the timer incremented at step 94 is compared to a predetermined calibration time KTB at step 108. As long as the time is less than KTB, the program exits the routine. However, when the time KTB expires, the value of the integral term of the closed loop correction term established by step 64 is stored in memory as INTB at step 110. This value is then subtracted from the value INTA stored at the beginning of the test at step 90 when the vacuum signal was first applied to the evaporative emission control system and the difference compared to a calibration constant KINT at step 112.

KINT is a predetermined value selected such that a difference greater than KINT will occur only if there are no air leaks or restrictions in the system and the vacuum signal was not sensed by the vacuum switch 56 as the result of a high vapor pressure in the fuel tank 26 (a condition resulting in a high volume of fuel vapor being drawn into the engine). Accordingly, a shift of the integral term less than KINT represents a fault free condition of the evaporative emission control system and when sensed at step 112, the OK flag is set at step 100 to indicate the fault free condition after which the system is returned to the normal pretest conditions via steps 102-104 as previously described.

However, if the vacuum switch 56 did not detect the vacuum signal as a result of air leaks or restrictions in the system and not as a result of high fuel vapor pressure in the system, the amount of fuel vapor drawn into the engine 10 intake manifold will not result in a shift in the integral term by the amount KINT over the time period KTB. Accordingly, a shift in the integral term less than KINT represents a fault condition of the evaporative emission control system and when sensed by step 112 the NOK flag is set at step 114 to indicate the fault condition after which the system is returned to the pretest condition via steps 102-106.

The foregoing description of a preferred embodiment of the invention for the purpose of illustrating the invention is not to be considered as limiting or restricting the invention since many modifications may be made by the exercise of skill in the art without departing from the scope of the invention.

I claim:

1. An evaporative emission control system for a vehicle having an internal combustion engine with an intake manifold, a fuel supply reservoir having a vapor space, means for delivering air and fuel to the intake manifold to be drawn into cylinders for combustion, and a closed loop air/fuel ratio controller for providing a closed loop adjustment of the ratio of air and fuel delivered to the intake manifold in direction and amount to maintain a predetermined ratio, the system comprising, in combination:

a vapor collection canister having an atmospheric air inlet exposed to atmospheric air;

a vapor line connected between the vapor space of the fuel supply reservoir and the canister for conveying fuel vapors from the fuel supply reservoir to the canister for collection therein;

a purge line connected between the vapor collection canister and the intake manifold, the vapor collection canister being purged of fuel vapors collected therein by air flow therethrough from the air inlet to the intake manifold through the purge line when the purge line is exposed to subatmospheric pressure in the intake manifold;

evaporative emission control system test means for (A) closing the atmospheric air inlet, (B) applying a subatmospheric pressure signal from the intake manifold to the purge line, (C) storing the closed loop adjustment amount when the subatmospheric pressure signal is first applied, (D) sensing for the subatmospheric pressure signal in the vapor space of the fuel reservoir, and (E) indicating a fault condition when the subatmospheric pressure signal is not sensed within a first time interval and when a difference between the closed loop adjustment amount at the end of a second interval and the stored adjustment amount is less than a predetermined value.

2. A method of testing the integrity of an evaporative emission control system of a vehicle having an internal combustion engine with an intake manifold, a fuel supply reservoir having a vapor space, means for delivering air and fuel to the intake manifold to be drawn into cylinders for combustion, and a closed loop air/fuel ratio controller for providing a closed loop adjustment of the ratio of air and fuel delivered to the intake manifold in direction and amount to maintain a predetermined ratio, the evaporative emission control system having a vapor collection canister having an atmospheric air inlet exposed to atmospheric air, a vapor line connected between the vapor space and the canister and a purge line connected between the vapor collection canister and the intake manifold, the method comprising the steps of:

closing the atmospheric air inlet;

applying a subatmospheric pressure signal from the intake manifold to the purge line;

storing the closed loop adjustment amount when the subatmospheric pressure signal is first applied; and sensing for the subatmospheric pressure signal in the vapor space of the fuel reservoir; and indicating a fault condition when the subatmospheric pressure signal is not sensed within a first time interval and when a difference between the closed loop adjustment amount at the end of a second interval and the stored adjustment amount is less than a predetermined value.

* * * * *